US009608387B2

(12) United States Patent
Loncar et al.

(10) Patent No.: US 9,608,387 B2
(45) Date of Patent: Mar. 28, 2017

(54) SHIELD CONNECTOR ARRANGEMENT

(71) Applicant: YAZAKI EUROPE LTD., Hertfordshire (GB)

(72) Inventors: Zelimir Loncar, Sesvete-Zagreb (HR); Goran Petrovic-Poljak, Zagreb (HR); Luka Ribaric, Samobor (HR); Zeljko Erdec, Zagreb (HR)

(73) Assignee: YAZAKI EUROPE LTD., Hertfordshire (GB)

( * ) Notice: Subject to any disclaimer, the term of this patent is extended or adjusted under 35 U.S.C. 154(b) by 75 days.

(21) Appl. No.: 14/552,923

(22) Filed: Nov. 25, 2014

(65) Prior Publication Data

US 2015/0180181 A1 Jun. 25, 2015

(30) Foreign Application Priority Data

Dec. 20, 2013 (EP) ..... 13198847

(51) Int. Cl.

| | |
|---|---|
| ***H01R 13/625*** | (2006.01) |
| ***H01R 24/38*** | (2011.01) |
| ***H01R 13/627*** | (2006.01) |
| ***H01R 13/6592*** | (2011.01) |
| *H01R 101/00* | (2006.01) |

(52) U.S. Cl.

CPC ..... *H01R 24/38* (2013.01); *H01R 13/627* (2013.01); *H01R 13/6271* (2013.01); *H01R 13/6275* (2013.01); *H01R 13/6592* (2013.01); *H01R 2101/00* (2013.01); *H01R 2201/26* (2013.01)

(58) Field of Classification Search

CPC H01R 9/032; H01R 13/65802; H01R 13/506; H01R 13/627; H01R 13/6271; H01R 13/6592; H01R 24/38; H01R 2101/00

USPC ..... 439/350, 357, 607.41

See application file for complete search history.

(56) References Cited

U.S. PATENT DOCUMENTS

| | | | | |
|---|---|---|---|---|
| 6,702,611 | B1 | 3/2004 | Miyazaki et al. | |
| 7,494,363 | B1 | 2/2009 | Wu | |
| 9,033,723 | B2 * | 5/2015 | Jeong | H01R 13/6272 439/352 |
| 9,142,919 | B2 * | 9/2015 | Osada | H01R 13/6272 439/352 |
| 2002/0090856 | A1 | 7/2002 | Weisz-Margulescu | |
| 2004/0014367 | A1 | 1/2004 | Petersen | |
| 2011/0171855 | A1 * | 7/2011 | Fujiwara | H01R 9/0518 439/607.41 |
| 2012/0258624 | A1 * | 10/2012 | Oh | H01R 13/5808 439/607.41 |

FOREIGN PATENT DOCUMENTS

| | | | |
|---|---|---|---|
| JP | 10-112924 | A | 4/1998 |
| JP | 2001-052817 | A | 2/2001 |
| JP | 2008-277035 | A | 11/2008 |

(Continued)

OTHER PUBLICATIONS

Communication from the Japanese Patent Office dated Nov. 10, 2016 in counterpart Japanese Application No. 2014-257535.

*Primary Examiner* — Khiem Nguyen

(74) *Attorney, Agent, or Firm* — Sughrue Mion, PLLC

(57) ABSTRACT

A shield connector 1 having a housing 4 with an insertion hole 14 for accommodating a shielded cable 7, wherein that at least one locking element 5 for tool-less fastening the shield connector 1 to a counterpart device 3 is provided on the housing 4.

11 Claims, 8 Drawing Sheets

(56) References Cited

FOREIGN PATENT DOCUMENTS

| | | | |
|---|---|---|---|
| JP | 2009-026590 | A | 2/2009 |
| JP | 2010-272419 | A | 12/2010 |
| JP | 2011-60613 | A | 3/2011 |
| JP | 2012-182011 | A | 9/2012 |
| WO | 2010/015641 | A1 | 2/2010 |

* cited by examiner

SHIELD CONNECTOR ARRANGEMENT

This invention relates to a shield connector and a shield connector arrangement for a cable with a shielding conductor for the connection of the cable to an electric or electronic device, for example, a battery, inverter or electric motor of an electric automobile as well as for the ground connection of the shielding conductor of the cable to a case of a counterpart device. In particular, the invention refers to a shield connector comprising a housing with an insertion hole for accommodating a shielded cable, a shielding terminal electrically connectable to a shielding conductor of said shielded cable wherein the shielding terminal is mounted to the housing and is configured such that it is electrically contactable to the case of a counterpart device for ground connection.

Such a shield connector is known from U.S. Pat. No. 6,280,208 B1 which discloses a shield connector structure for connecting a metal case of a motor as a device and a shielding conductor of a shielded cable. The shield connector structure comprises a shield connector which has a housing with a flange portion. The flange portion is integrally formed in one piece with the housing. The flange portion has a bolt insertion hole so as to be fixed to a counterpart metal case by fastening with a bolt. The shield connector of the shielded cable is electrically connected to a shield terminal which has a flange portion being arranged between the flange portion of the housing and the counterpart metal case in order to establish a electric connection between the shielding conductor of the shielded cable and the metal case.

Another shield connector is disclosed in EP 2 463 959 A1 which also has a housing with an integrally formed flange portion so as to be fixed to a counterpart metal case by fastening with a bolt.

It is the object of the invention to provide a shield connector which can easily and quick be fastened to a counterpart device.

The object is achieved with a shield connector comprising a housing with an insertion hole for accommodating a shielded cable, and a shielding terminal electrically connectable to a shielding conductor of said shielded cable wherein the shielding terminal is mounted to the housing and is configured such that it is electrically contactable to the case of a counterpart device for ground connection, wherein the housing is provided with at least one locking element for tool-less fastening the shield connector to said case of the counterpart device.

Using a shield connector according to the invention it is not necessary to use a separate tool for the fixation of the shield connector to the counterpart device. Neither, it is necessary to provide additional parts such like screws in order to establish a connection between the shield connector and a counterpart device. The shield connector according to the invention enables a fast process to fasten the shield connector to the counterpart device without the use of tools and at the same time providing a secure ground connection between the shield terminal and the case of the counterpart device while a conductor of the shielded cable can be connected to a further cable arranged within the case of the counterpart device.

The housing may have just one locking element. In order to achieve higher fastening forces two locking elements can be provided wherein the locking elements are preferably arranged diametrically opposed relative to a longitudinal axis of the housing. The diametrically opposed arrangement of the locking elements further provide for a secure connection between the shield connector and the counterpart device avoiding bending forces as much as possible. In order to further minimize bending forces onto the locking element more than two locking elements can be provided, which are evenly distributed around longitudinal axis of the housing.

Each locking element can be formed such that it can be brought into engagement with a counter locking element of the counterpart device. The at least one locking element and the respective at least one counter locking element are preferably designed such that by mating the shield connector with the counterpart device the locking element and the counter locking element are brought into engagement automatically without the need to first move the locking element or the counter locking element into a specific position.

The at least one locking element may comprise a locking arm which is deflectable between a locked position and an unlocked position. The locking arm can further comprise an engagement portion to be brought into engagement with an engagement portion of the counter locking element. The engagement portion of the locking arm and the engagement portion of the counter locking element are preferably designed such that the locking arm is moved from the locked position to an unlocked position and finally again to a locked position engaging the engagement portion of the counter locking element only by moving the shield connector relative to the counterpart device during a mating procedure.

For unlocking the locking arm preferably comprises an actuation portion for manually deflecting the locking arm from its locked position into its unlocked position.

In order to secure the shield connector from being unmated unintentionally the locking element comprises a secondary locking device being moveable between a pre-set position and a set position. The secondary locking device, in its set position, secures the locking arm in the locked position. In order to unmate the shield connector from the counterpart device first the secondary locking device has to be moved from its set position into its pre-set position so that the locking arm can be manually deflected, preferably by an actuation portion, from its locked position into its unlocked position so that the shield connector can be unmated.

In a preferred embodiment the at least one locking element is mounted detachable to the housing. In order to facilitate a detachable but secure connection between the at least one locking element and the housing the locking element comprises a securing arm which is deflectable between a secured position and an unsecured position. The securing arm preferably comprises an engagement portion to be brought into engagement with an engagement portion of the housing. In order to enable an easy process of securing the at least one locking element to the housing the engagement portion of the securing arm and the engagement portion of the housing are designed such that only by sliding the locking element onto the housing the engagement portion of the securing arm is brought into engagement with the engagement portion of the housing without the need to use a tool or to manually deflect the securing arm.

The housing can be made of aluminum and the at least one locking element may be made from a plastic material or synthetic resin.

In a further embodiment the at least one locking element is integrally formed with the housing in one piece. The housing and the at least one locking element can be made from a plastic material or a synthetic resin.

The shielded cable is inserted into the insertion hole of the housing, wherein the shielded cable comprises a shielding conductor such like a braided conductor surrounding a main conductor of the cable. The shielding conductor is connected to the shield terminal.

The object is further achieved by a shield connector arrangement comprising a shield connector as described above, wherein the shield connector arrangement further comprises a counterpart device having at least one counter locking element being engaged to the at least one locking element of the housing of the shield connector.

The shield connector arrangement may further comprise a shielded cable accommodated within the insertion hole, said shielded cable has a shielding conductor being electrically connected to the shield terminal.

The shielded cable preferably is guided through a wall of the counterpart device and has a conductor to be connected to a conductor of a further cable within the case of the counterpart device.

Embodiments of the invention will now be described, by way of example, with reference to the accompanying drawings, wherein.

Figure 1:
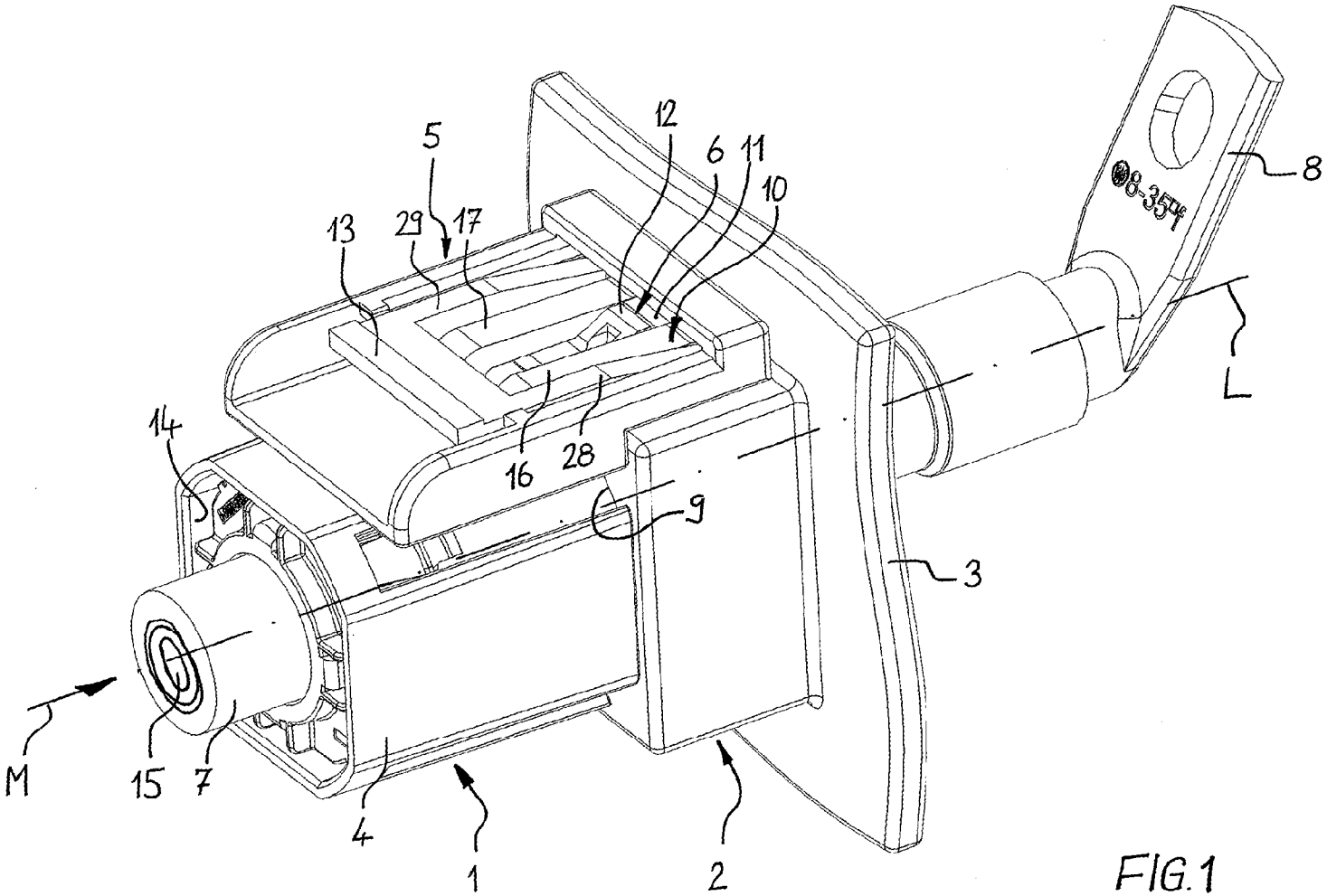
FIG. 1 is a perspective view of a first embodiment of a shield connector with a shielded cable having an eyelet terminal, wherein the shield connector is fastened to a wall of a counterpart device.

FIGS. 1 to 4 show a first embodiment of a shield connector 1. FIG. 1 depicts a perspective view of the first embodiment of the shield connector 1, fastened to a counter connector portion 2 of a wall of a counterpart device 3 wherein the wall of a counterpart device 3 is part of a case of the counterpart device. The shield connector 1 comprises a housing 4 and a locking element 5. The locking element 5 is integrally formed with the housing 4 in one piece and is made, preferably, from a synthetic resin material. For locking the shield connector 1 to the counter connector portion 2 the locking element 5 can be brought into engagement with a counter locking element 6 of the counter connector portion 2 without using a tool.

A shielded cable 7 penetrates an insertion hole 14 of the housing 4 and terminates on a side of the wall of the counterpart device 3 which is opposite to the shield connector 1. At the terminating end the shielded cable 7 has an eyelet terminal 8 which is electrically connected to a conductor 15 of the shielded cable 7. The eyelet terminal 8 is used for a high voltage interconnection between, for instance, a terminal of a further cable (not shown) to a battery and another electrical components such as an inverter or a motor of a vehicle. The terminal of the further cable is arranged within the case of the counterpart device.

The counter connector portion 2 comprises a receptacle 9 into which the housing 4 is partly inserted. The shielded cable 7 is completely guided through the wall of the counterpart device 3.

For locking the shield connector 1 to the counter connector portion 2 the locking element 5 comprises a locking arm 10 having an engagement portion 11. The counter locking element 6 comprises a locking projection 12. The engagement portion 11 of the locking arm 10 is engaged with the locking projection 12, so that the shield connector 10 is securely held at the counter connector portion 2 against a movement against a mating direction M for mating the shield connector 1 to the counter connector portion 2.

In order to disengage the engagement portion 11 from the locking projection 12 the locking arm 10 has an actuation portion 13 for manually manipulating the locking arm 10. In FIG. 1 the locking arm 10 is shown in a locked position engaging the locking projection 12. By pressing down the actuation portion 13 the locking arm 10 can be deflected into an unlocked position in which the engagement portion 11 is lifted from the locking projection 12 so that the shield connector 10 can be moved against the mating direction M out of the receptacle 9.

Figure 2:
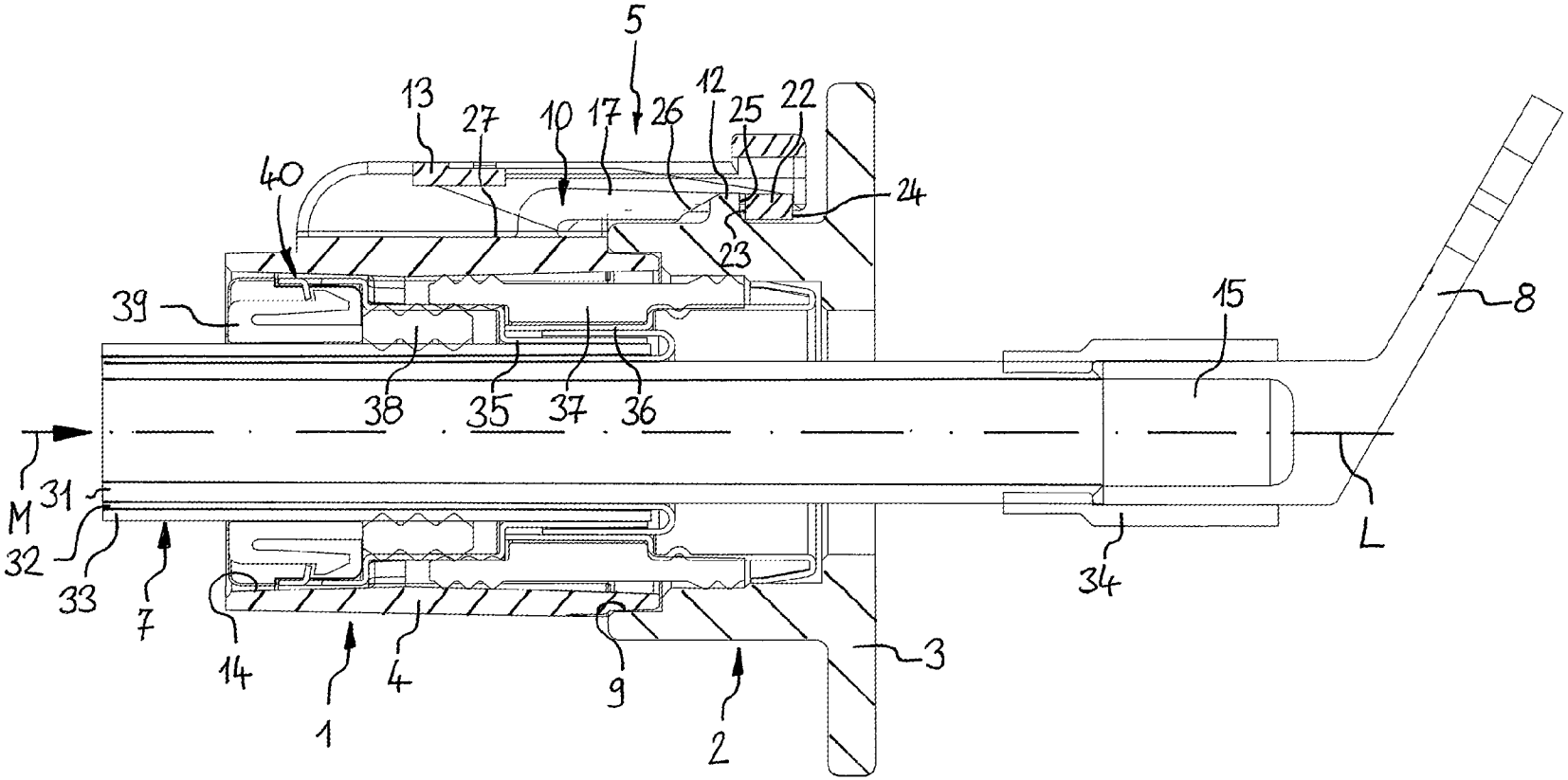
FIG. 2 is a longitudinal section of the shield connector with cable fastened to the wall of a counterpart device according to FIG. 1.
Figure 3:
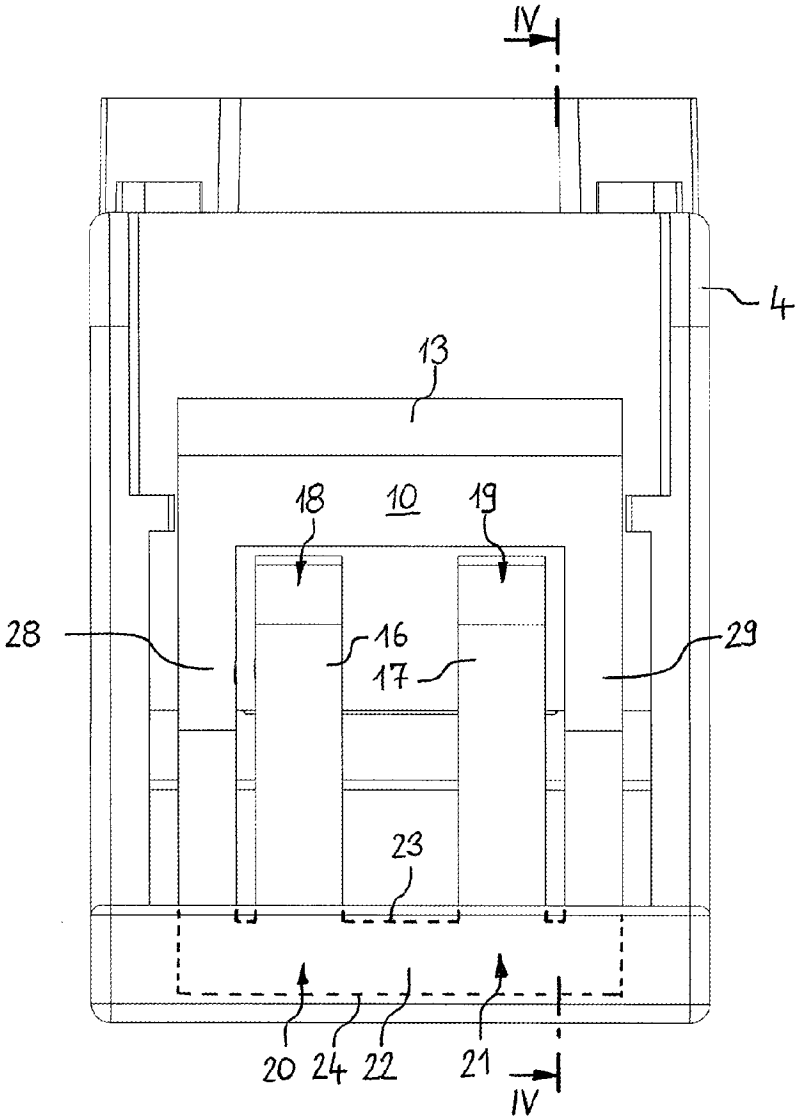
FIG. 3 is a top view of the housing of the shield connector according to FIG. 1.
Figure 4:
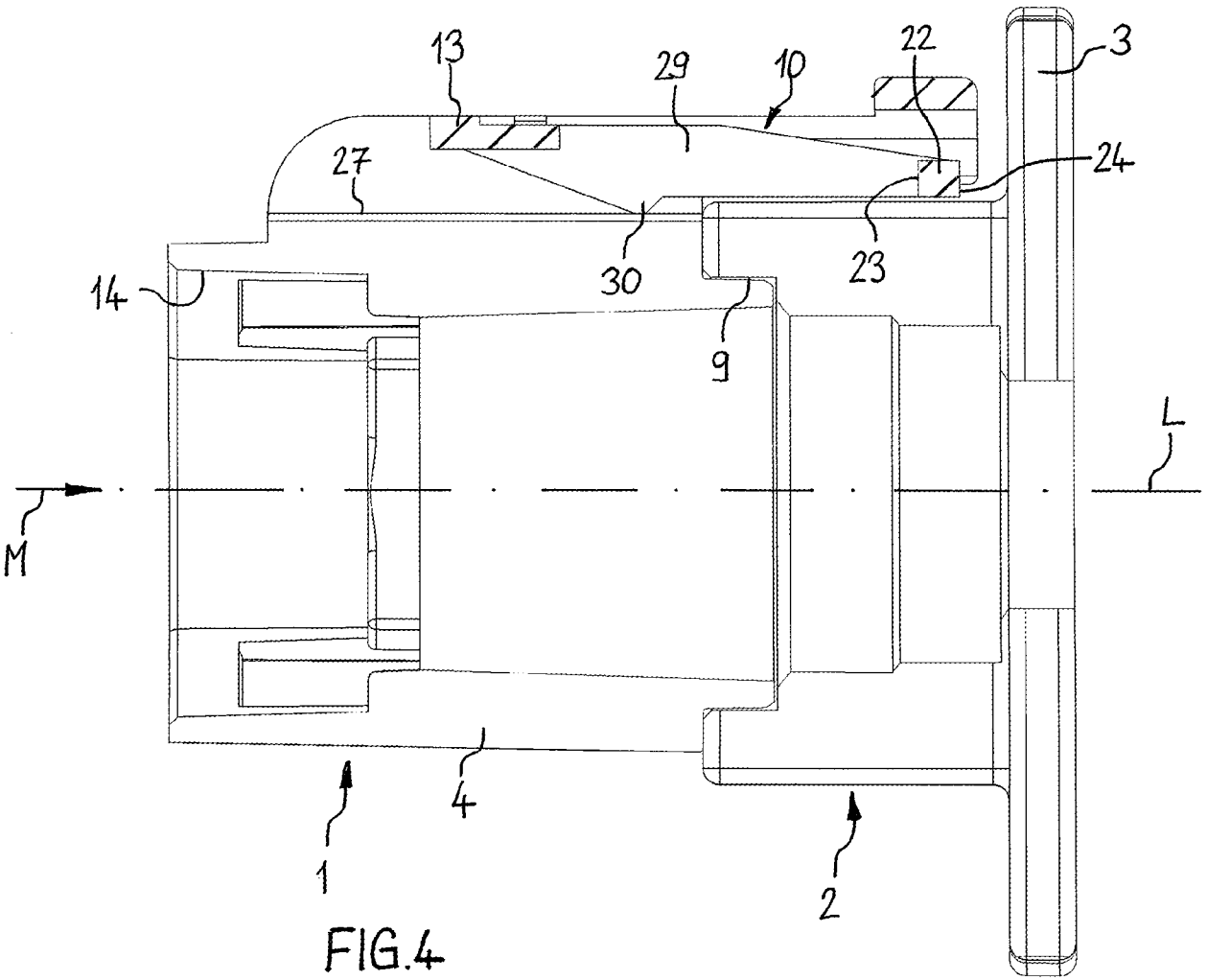
FIG. 4 is a longitudinal section of the housing and the wall of a counterpart device according to FIG. 1 along the section line IV-IV according to FIG. 3.

The locking element 5 and the counter locking element 6 can be more clearly seen in FIGS. 2 to 4.

The locking arm 10 will be now described in more detail with reference to FIG. 3. The locking arm 10 comprises two parallel orientated resilient arms 16, 17 which each have a first end 18, 19 which is connected and integrally formed to the housing 4. At opposite side of the first ends 18, 19 the resilient arms 16, 17 each have a second end 20, 21. The resilient arms 16, 17 are connected to each other by a bridge portion 22 which is connected to the second ends 20, 21 of the resilient arms 16, 17. The bridge portion 22 is arranged in a relaxed and unbent state with a distance to an upper surface 27 of the housing. The bridge portion 22 forms a locking face 23 which faces, seen in a mating direction M, to the rear of the housing 4. Opposite to the locking face 23 the bridge portion 22 has a front face 24.

As best can be seen in FIG. 2 the locking projection 12 has a counter locking face 25. In the mated condition of the shield connector 1 to the counter connector portion 2 the locking face 23 is arranged opposite to the counter locking face 25 so that the locking face 23 and the counter locking face 25 are facing each other. If a force is applied to the housing 4 against the mating direction M the locking face 23 is supported against the counter locking face 25 so that the shield connector 1 cannot be unmated from the counter connector portion 2. In order to enable an unmating of the shield connector 1 from the counter connector portion 2 the locking arm 10 can be displaced from the locked position as shown in FIG. 2 in an unlocked position in which the bridge portion 22 is lifted to a position, in which it has a greater distance to the upper surface 27 of the housing 10, or in other words the bridge portion 22 has a greater distance to a longitudinal axis L of the housing in the unlocked position than in the locked position. In the unlocked position (not shown) the locking face 23 does not overlap the counter locking face 25 seen in the mating direction M so that the shield connector 1 can be moved against the mating direction M while the bridge portion 22 passes the locking projection 12.

For moving the locking arm 10 from the locked position into the unlocked position the locking arm 10 comprises the actuation portion 13 which can be manually pushed in a direction towards the upper surface 27 of the housing 3. Therefore, the locking arm 10 has two levers 28, 29 which are orientated parallel to the resilient arms 16, 17 and which are also connected to the bridge portion 22 and project from the bridge portion 22 in the same direction as the resilient arms 16, 17. On one side of the levers 28, 29 which is opposite to the bridge portion 22 the levers 28, 29 are connected to each other by the actuation portion 13. As can be seen in FIG. 4, the levers 28, 29 are provided with a pivot projection 30 projecting from the levers 28, 29 towards the upper surface 27 of a housing 4. The pivot projections 30 are supported against the upper surface 27 so that the locking arm 10 pivots about the two pivot projections 30 of each lever 28, 29 in the area of the contact between the pivot projections 30 and the upper surface 27 so that by pressing down the actuation portion 13 towards the upper surface 27 the bridge portion 22 is raised in a position in which it has a greater distance to the longitudinal axis L.

The details of the shield connector 1 are explained with reference to FIG. 2. The shielded cable 7 is a commonly used coaxial cable having an inner conductor 15, an inner insulation 31 covering the conductor 15, a shielding conductor 32 arranged around the inner insulation 31 and an outer insulation 33 covering the shielding conductor 32. At a connection end the shielded cable 7 is connected to the eyelet terminal 8. At the connection end the shielded cable 7 is stripped from the insulations 31, 33 stepwise. The end of the conductor 15 is electrically connected to the eyelet terminal 8. The eyelet terminal 8 is sealed by a heat shrink tube 34 which is arranged around the inner insulation 31 as well as a connection end of the eyelet terminal 8. The heat shrink tube 34 ensures that the connection between the shielded cable 7 and the eyelet terminal 8 is sealed so that no moisture or water can enter between the conductor 15 and the inner insulation 31. Further, the outer insulation 33 is stripped off the shielding conductor 32 so that a connection end of the shielding conductor 32 is arranged barely on the inner insulation 31. At this connection end of the shielding conductor 32 the shielding conductor 32 is everted backwards in a direction away from the eyelet terminal 8 and is arranged around the outer insulation 32. The everted end of the shielding conductor 32 is clamped between a sleeve 35 and a shield terminal 36 wherein the shield terminal 36 is shaped sleeve like. The shield terminal 36 projects in an axial direction out of the housing 4 and is in contact with the receptacle 9 of the wall of the counterpart device 3. The wall of the counterpart device 3 is made of metal so that an electric contact between the shielding conductor 32 of the shielded cable 7 and the counterpart device 3 is established for ground connection.

In the area in which the shielding conductor 32 is clamped between the sleeve 35 and the shield terminal 36 a sealing ring 37 (unit seal) is arranged around the shield terminal 35 which is on the one hand in sealing contact to the sleeve 35 and on the other hand in sealing contact to an inner surface of the insertion hole 14 of a housing 4 and to an inner surface of the receptacle 9 of the counterpart device 3. In addition, between the sleeve 35 and the outer insulation 33 a further sealing ring 38 (wire seal) is arranged. On the side opposite to the eyelet terminal 8 the shield connector 1 is provided with a locking ring 39 (rubber stopper) which is mounted to the sleeve 35 by a catch mechanism 40.

Figure 5:
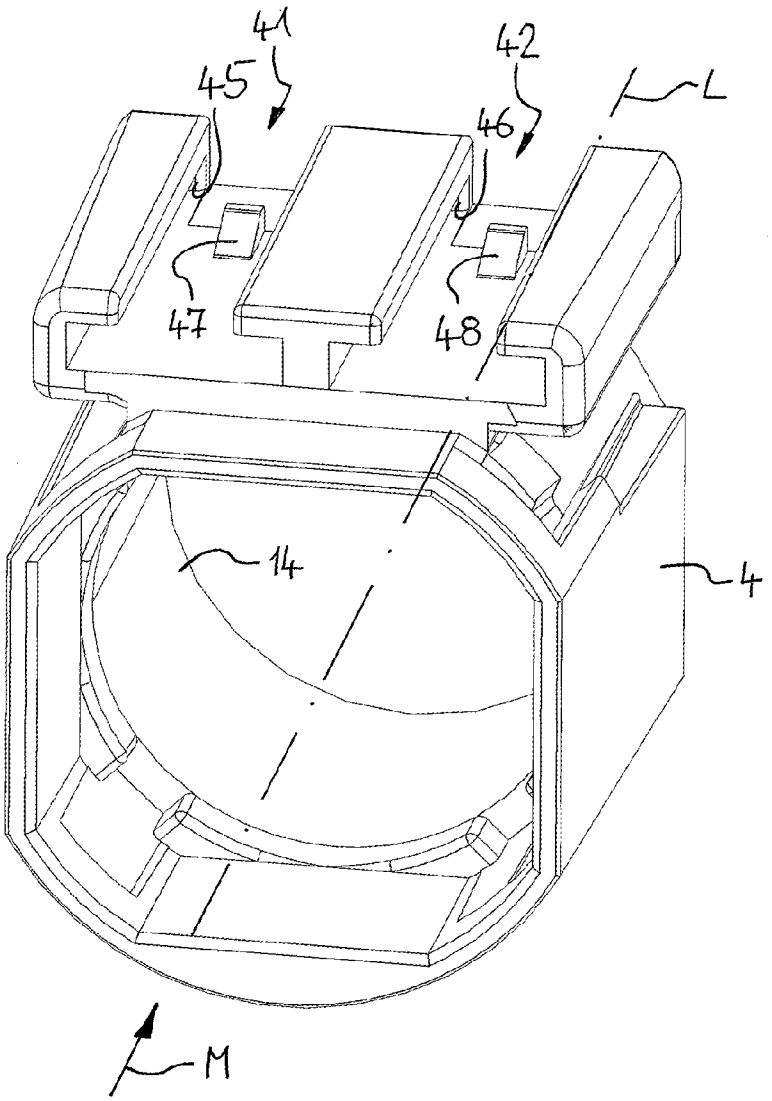
FIG. 5 is a perspective view of a housing of a second embodiment of a shielding connector.
Figure 6:
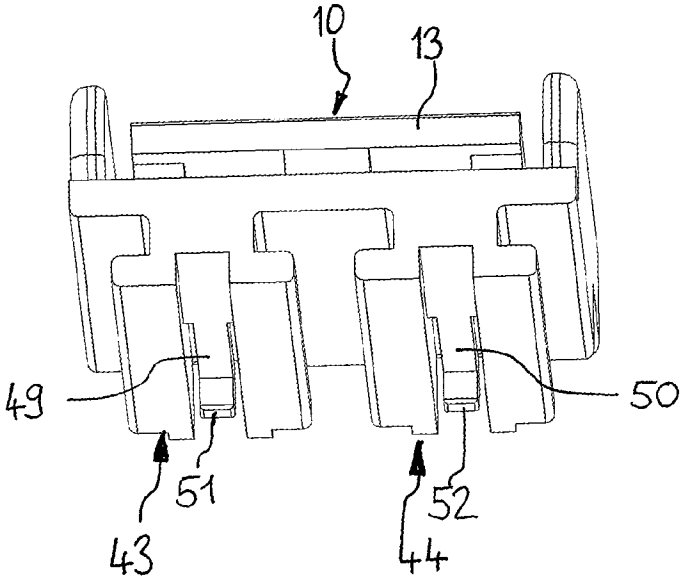
FIG. 6 is a perspective view of a locking element of a second embodiment of a shielding connector.
Figure 7:
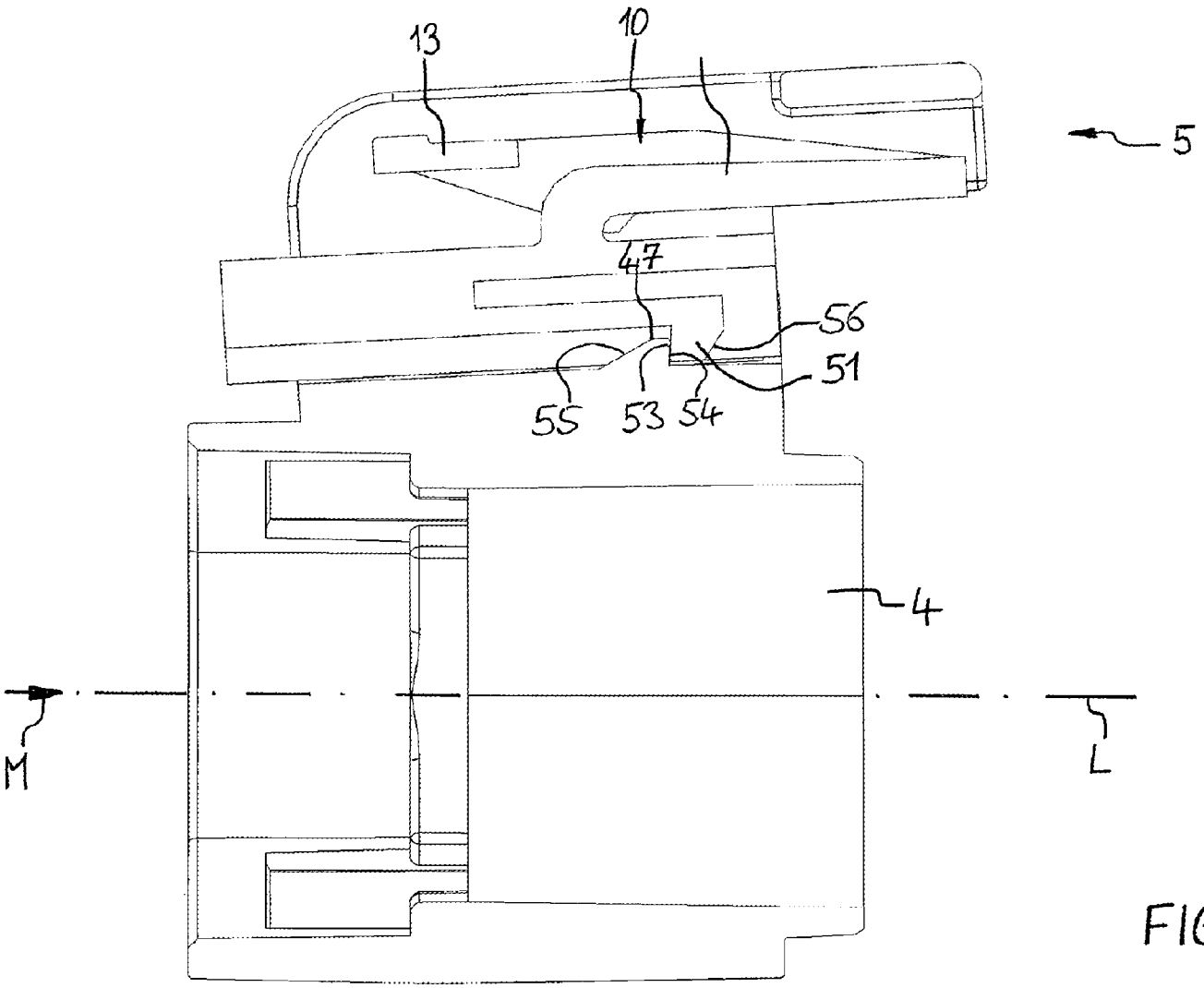
FIG. 7 is a longitudinal sectional view of the housing and a locking element of a second embodiment of the shield connector.

FIGS. 5, 6 and 7 refers to a second embodiment of a shield connector 1 and are described together. Elements and features which are identical to the elements and features of the first embodiment are indicated with the same reference numerals and are described in connection with the first embodiment.

The difference of the shield connector 1 of the second embodiment compared to the first embodiment is that the housing 4 and the locking element 5 are not integrally formed as one piece. Instead, the locking element 5 is detachably secured to the housing 4. The housing is provided with two slots 41, 42. The locking element 5 has two respective rails 43, 44 which can be inserted into the slots 41, 42 in the mating direction M parallel to the longitudinal axis L. Each slot 41, 42 has stop faces 45, 46. The rails 43, 44 of the locking element 5 abut against the stop faces 45, 46 when the locking element 5 has been completely slit into the slots 41, 42. In the completely slit-in condition the locking element 5 is secured to the housing 4. For securing the locking element 5 to the housing 4 the locking element 5 is provided with two securing arms 49, 50, one per slot 41, 42. The securing arms 49, 50 are provided with engagement portions 51, 52 projecting towards the housing 4 and which engage engagement portions 47, 48 which are arranged in the slots 41, 42 of the housing 4. In the completely slit-in condition securing faces 53 of the engagement portions 51, 52 of the securing arms 49, 50 are supported against counter securing faces 54 of the engagement portions 47, 48 of the housing 4. When a locking element 5 is slit into the slots 41, 42 a front face 56 of the securing arms 49, 50 rides along a slant surfaces 55 of the engagement portions 47, 48 of the housing 4 so that the securing arms 49, 50 are deflected away from the housing so that the engagement portions 51, 52 of the securing arms 49, 50 can pass the engagement portions 47, 48 of the housing 4. When the locking element 5 has reached its completely slit-in condition the engagement portions 51, 52 of the securing arms 49, 50 have passed the engagement portions 47, 48 of the housing 4 so that the securing arms 49, 50 can deflect back into the condition as depicted in FIG. 7.

Figure 8:
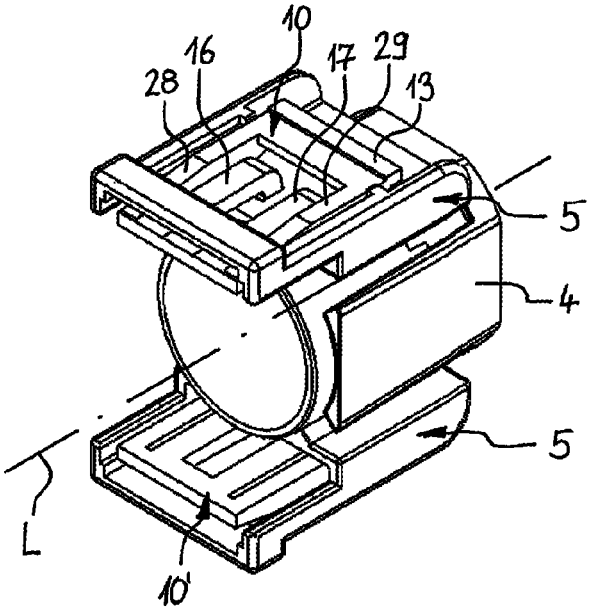
FIG. 8 is a perspective view of a housing of a third embodiment of a shield connector.
Figure 9:
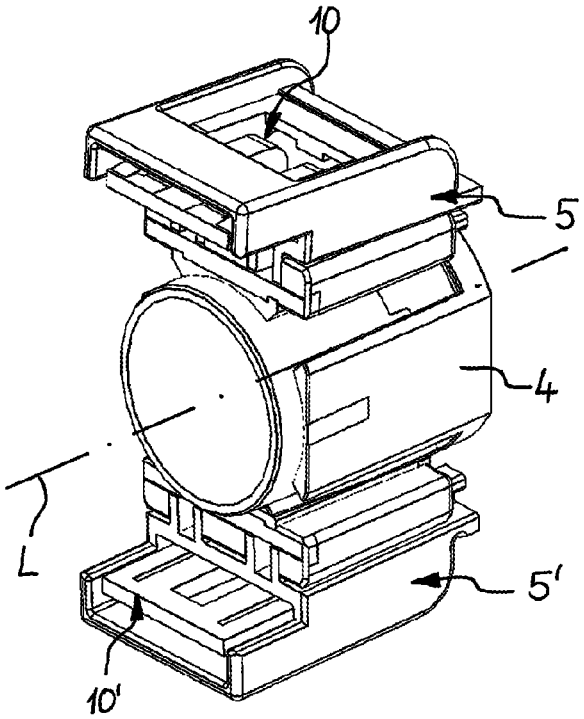
FIG. 9 is a perspective view of a housing with separate locking elements of a fourth embodiment of a shield connector.

FIG. 8 discloses a housing 4 of a third embodiment of a shield connector having two locking elements 5 being arranged diametrical opposed to each other relative to the longitudinal axis L. The housing according to FIG. 8 shows locking elements 5, 5' which are integrally formed with the housing. FIG. 9 shows another (fourth) embodiment having locking elements 5, 5' which are detachably mounted to the housing 4.

REFERENCE NUMERALS

1 shield connector
2 counter connector portion
3 wall of counterpart device
4 housing
5 locking element
6 counter locking element
7 shielded cable
8 eyelet terminal
9 receptacle
10 locking arm
11 engagement portion
12 locking projection
13 actuation portion
14 insertion hole
15 conductor
16 resilient arm
17 resilient arm
18 first end
19 first end

20 second end
21 second end
22 bridge portion
23 locking face
24 front face
25 counter locking face
26 slant surface
27 upper surface
28 lever
29 lever
30 pivot projection
31 inner insulation
32 shielding conductor
33 outer insulation
34 heat shrink tube
35 sleeve
36 shield terminal
37 sealing ring (unit seal)
38 sealing ring (wire seal)
39 locking ring (rubber stopper)
40 catch mechanism
41 slot
42 slot
43 rail
44 rail
45 stop face
46 stop face
47 engagement portion
48 engagement portion
49 securing arm
50 securing arm
51 engagement portion (of the securing arm)
52 engagement portion (of the securing arm)
53 securing face
54 counter securing face
55 slant surface
56 front face
L longitudinal axis
M mating direction

The invention claimed is:

1. A connector arrangement comprising:

a shield connector having a housing with an insertion hole, the housing having at least one locking element;

a shielded cable accommodated within the insertion hole, said shielded cable has a shielding conductor connected to a shielding terminal, said shielded cable further having a terminal, for a connection to a further cable to a battery or another electrical component, electrically connected to a conductor of the shielded cable, wherein the shielding terminal is mounted to the housing:

a counterpart device including a case and having at least one counter locking element being engaged to the at least one locking element of the housing of the shield connector for tool-less fastening the shield connector to said case of the counterpart device, wherein the shielded cable is guided through a wall of the counterpart device, and wherein the shielding terminal is in contact to the wall of the counterpart device for ground connection between the shielding conductor and the counterpart device.

2. The connector arrangement according to claim 1, wherein two locking elements are provided being arranged diametrically opposed relative to a longitudinal axis of the housing.

3. The connector arrangement according to claim 1, wherein the at least one locking element is formed such that it can be brought into engagement with a counter locking element of the counterpart device.

4. The connector arrangement according to claim 1, wherein the at least one locking element comprises a locking arm which is deflectable between a locked position and an unlocked position.

5. The connector arrangement according to claim 4, wherein the locking arm comprises an engagement portion to be brought into engagement with an engagement portion of the counter locking element.

6. The connector arrangement according to claim 4, wherein the locking arm comprises an actuation portion for manually deflecting the locking arm.

7. The connector arrangement according to claim 4, wherein the at least one locking element comprises a secondary locking device being movable between a pre-set position and a set position and that the secondary locking device in its set position secures the locking arm in the locked position.

8. The connector arrangement according to claim 1, wherein the at least one locking element is mounted detachable to the housing.

9. The connector arrangement according to claim 8, wherein the at least one locking element comprises a securing arm which is deflectable between a secured position and an unsecured position.

10. The connector arrangement according to claim 9, wherein the securing arm comprises an engagement portion to be brought into engagement with an engagement portion of the housing.

11. The connector arrangement according to claim 1, wherein the at least one locking element is integral with the housing in one piece.

* * * * *